US008057284B2

(12) United States Patent
Leonhardt

(10) Patent No.: US 8,057,284 B2
(45) Date of Patent: Nov. 15, 2011

(54) TOOL FOR POLISHING AND FINE-GRINDING OPTICALLY ACTIVE SURFACES IN PRECISION OPTICS

(75) Inventor: Christian Leonhardt, Merenbert/Reichenborn (DE)

(73) Assignee: Satisloh GmbH, Wetzlar (DE)

( * ) Notice: Subject to any disclaimer, the term of this patent is extended or adjusted under 35 U.S.C. 154(b) by 336 days.

(21) Appl. No.: 12/386,703

(22) Filed: Apr. 22, 2009

(65) Prior Publication Data

US 2010/0151773 A1 Jun. 17, 2010

(30) Foreign Application Priority Data

Dec. 15, 2008 (DE) ..... 20 2008 016 454 U

(51) Int. Cl.
*B24B 5/00* (2006.01)

(52) U.S. Cl. ..... 451/283; 451/277

(58) Field of Classification Search ..... 451/42, 451/282, 283, 158, 277, 43, 285, 504, 505
See application file for complete search history.

(56) References Cited

U.S. PATENT DOCUMENTS 3,128,580 A 4/1964 Davis
4,167,218 A * 9/1979 Horiuchi et al. ..... 173/213
5,255,474 A 10/1993 Gawa et al.
5,421,770 A * 6/1995 Bobst ..... 451/390
5,957,756 A * 9/1999 Figge et al. ..... 451/49
7,396,275 B2 * 7/2008 Drain et al. ..... 451/11
7,588,480 B2 * 9/2009 Kuebler ..... 451/41
2003/0045211 A1 3/2003 Kuebler
2006/0199481 A1 9/2006 Urban et al.
2008/0305723 A1 12/2008 Philipps et al.

FOREIGN PATENT DOCUMENTS

EP 0 974 423 B1 9/2002

OTHER PUBLICATIONS

German Recherchebericht for Priority Case DE 20 2008 016 454.0, 4 pages.

* cited by examiner

*Primary Examiner* — Dung Van Nguyen
(74) *Attorney, Agent, or Firm* — Reising Ethington P.C.

(57) ABSTRACT

A tool for polishing and fine-grinding optically active surfaces in precision optics has a main body which can be attached in a rotationally fixed manner to a tool spindle of a machining machine. A guide element is arranged concentrically in the main body and is mounted such that it can be displaced axially therein. A machining disk is replaceably attached to the outer end of the guide element. The main body is rigidly connected in a rotationally fixed manner, over the full displacement travel, to the guide element mounted such that it can be displaced axially therein, and in that the machining disk is rigidly fixed in a non-tiltable manner on the guide element.

9 Claims, 3 Drawing Sheets

TOOL FOR POLISHING AND FINE-GRINDING OPTICALLY ACTIVE SURFACES IN PRECISION OPTICS

TECHNICAL FIELD

The invention relates to a tool for polishing and fine-grinding optically active surfaces in precision optics, including aspherical, spherical and free-form surfaces. The tool comprises a main body which can be attached in a rotationally fixed manner to a tool spindle of a machining machine, a guide element which is arranged concentrically in the main body and is mounted such that it can be displaced axially therein, and a machining disk which is replaceably attached to the outer end of the guide element and on the outer surface of which polishing and/or grinding means are provided.

In machining by means of polishing or fine-grinding, the tool and the workpiece rotate in the same or opposite directions, while the tool and the workpiece are pivoted relative to one another so that the area of engagement between the tool and the workpiece continuously changes through a path-controlled process.

BACKGROUND OF THE INVENTION

In such a known tool (EP 1 698 432 A2) for the fine-machining of optically active surfaces, in particular on spectacle lenses, a spherical head is arranged at the end of the guide element and engages in an associated receiving chamber of the machining disk, so that the machining disk can tilt relative to the guide element at the spherical head. If, for example, a higher relative machining speed is desired in order to increase the removal of material, the tool must be brought into engagement with the workpiece in the edge region, i.e. at a radial distance from the tool rotation axis. In this case, a return movement of the machining disk relative to the workpiece in the direction of the tool rotation axis may be obtained by tilting the machining disk at the spherical head. This may result in relative positions between the machining disk and the workpiece in which an undefinable removal of material on the workpiece is obtained, which is undesirable in applications in precision optics. In the known tool, the rotating drive of the machining disk takes place by means of an elastic bellows, which is fixed on the one hand to the main body and on the other hand to the machining disk by ring clips.

What is needed is a tool of the type specified in the introduction, which allows a stable, clearly definable polishing and/or fine-grinding process for applications in precision optics.

SUMMARY OF THE INVENTION

According to the invention, a tool for polishing and fine-grinding optically active surfaces in precision optics is characterized in that the main body is rigidly connected in a rotationally fixed manner, over the full displacement travel, to the guide element mounted such that it can be displaced axially therein, and in that the machining disk is rigidly fixed in a non-tiltable manner on the guide element.

By virtue of a rigid axial guidance of the machining disk by the guide element and the rigid, inelastic rotational entrainment of the polishing disk, a very precise positioning of the machining disk relative to the workpiece and thus of the point of engagement between the tool and the workpiece is possible.

In a further embodiment of the invention, it is provided that a stop pin is inserted in the guide element transversely to the tool rotation axis and, in order to connect the main body to the guide element in a rotationally fixed manner, engages in an axial groove which is provided in the main body and the axial length of which limits the maximum displacement travel of the guide element in the main body. In this case, by means of a spring force acting axially on the guide element, the guide element is displaced in the basic position of the tool until the stop pin comes into abutment against one end of the axial groove.

In accordance with another aspect of the invention, a stepped bore is provided in the main body to accommodate the guide element in a manner coaxial with the tool rotation axis, and the guide element has a shaft section and a head section, of which the shaft section emerges from the main body in the direction of the machining disk through a guide section having the smallest diameter of the stepped bore. The head section of the guide element is guided in a bore section of larger diameter, wherein the stepped bore is closed at its end adjacent to the tool spindle by a closure piece which can be fixed to the main body.

In order to fix this closure piece, the arrangement may be such that the closure piece has a central bore coaxial with the tool rotation axis and provided with an internally threaded section, wherein provided in the closure piece are a plurality of threaded bores which extend radially to the central bore and into which pin screws are screwed in order to fix the closure piece in the stepped bore.

The tool according to the invention can advantageously be adapted to different machining machines while using largely the same components, as will be described in more detail below. While polishing machines usually have a compressed air system which can be used to apply pressure to the tool, usually no such system is provided on grinding machines. The necessary adaptation of the tool according to the invention to both types of machine is limited here essentially to replacing an elastic membrane for compressed air operation with a compression spring, and using a polishing disk or a fine-grinding disk. The tool according to the invention is therefore an advantageous combination tool for both applications.

For compressed air operation, the arrangement is such that a grub screw which has a through-bore is screwed into the internally threaded section of the central bore of the closure piece, and that a first helical compression spring which surrounds the shaft section of the guide element is inserted between the head section of the guide element and a step of the stepped bore. This first helical compression spring, in the basic position of the tool, keeps the stop pin in the position of abutment against the end of the axial groove of the main body adjacent to the first helical compression spring. In this case, attached to the closure piece is an elastic membrane which bears against the head section of the guide element and can be made to bulge outwards by supplying compressed air through the through-bore in order to displace the guide element so as to generate the machining pressure on the workpiece and, in its maximum bulging position, keeps the stop pin in the position of abutment against the end of the axial groove of the main body facing towards the machining disk, counter to the force of the first helical compression spring.

For operation without compressed air, the arrangement is advantageously selected such that a grub screw is screwed into the internally threaded section of the central bore of the closure piece, against which grub screw there is supported one end of a second helical compression spring which can be adjusted by the grub screw in terms of its prestress and which in this embodiment generates the machining pressure on the workpiece, wherein the other end of said second helical compression spring bears against the head section of the guide element and, in the basic position of the tool, keeps the stop pin in the position of abutment against the end of the axial groove of the main body facing towards the machining disk.

Both embodiments of the tool also share the common feature that, a beaker-shaped part is pushed with movement play in a telescopic manner onto the cylindrical end of the main body facing towards the machining disk, which beaker-shaped part is fixed to the guide element by a central screw.

When the tool is equipped for polishing, it is advantageously provided that a holding section is fixed to the beaker-shaped part by a plurality of screws and serves for the latching connection of the machining disk designed as a polishing disk in a rotationally fixed manner. Due to this latching possibility, the polishing disk can easily be replaced.

When the tool is equipped as a grinding tool, it is advantageously provided that the beaker-shaped part and the machining disk designed as a grinding disk, which bears against the beaker-shaped part, are jointly fixed to the guide element by the aforementioned central screw. In this case, the rotational entrainment of the grinding disk when the tool is driven in rotation is ensured by at least one cylindrical pin which connects the grinding disk to the beaker-shaped part and which is arranged at a radial distance from the tool rotation axis.

To encapsulate the parts of the tool which can be displaced with one another, it is advantageously provided that the main body and the beaker-shaped part are connected to one another by a surrounding bellows.

BRIEF DESCRIPTION OF THE DRAWINGS

The invention will be explained in more detail below on the basis of two preferred examples of embodiments and with reference to the appended drawings, wherein identical or corresponding parts are provided with the same reference numerals. In the drawings.

DETAILED DESCRIPTION OF THE EXAMPLES OF EMBODIMENTS

Figures 1, 2, 3, 4:
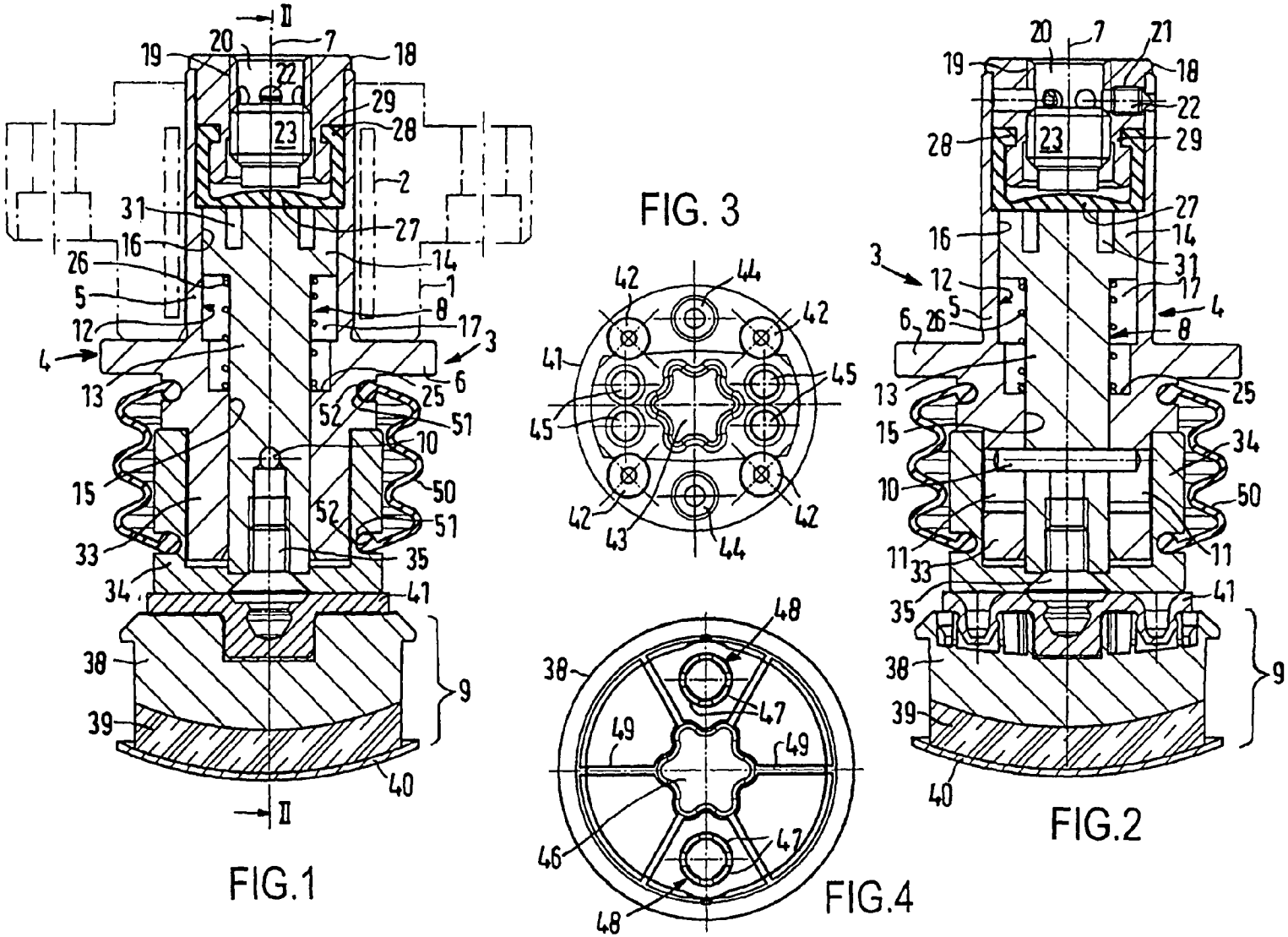
FIG. 1 shows a longitudinal section through a polishing tool equipped for compressed air operation, in the basic position of the tool without any pressure being applied.
FIG. 2 shows a further longitudinal section through the polishing tool along the section line II-II in FIG. 1.
FIG. 3 shows the bottom view of the holding section for the polishing disk, which is shown in section in FIGS. 1 and 2.
FIG. 4 shows the plan view of the fixing side of the polishing disk shown in section in FIGS. 1 and 2.

Of the polishing machine equipped with a compressed air system, only the tool spindle 1 having a DIN connection is shown in dash-dotted line in FIG. 1. The tool spindle 1 has a hydraulic chuck 2, by means of which the tool 3 is attached to the tool spindle 1 in a rotationally fixed manner. The tool 3 is introduced into the tool spindle 1 by a shaft 5 provided on its main body 4, until a flange 6 of the main body 4 comes into abutment, and is thereby fixed in a precise axial position.

A guide element 8 is arranged in the main body 4 concentrically to the tool rotation axis 7 and is mounted such that it can be displaced axially therein to a limited extent, as will be described in more detail below. A polishing disk 9 is replaceably attached to the outer end of said guide element. As will likewise be described below, the main body 4 is rigidly connected in a rotationally fixed manner, over the entire displacement travel, to the guide element 8 axially displaceable therein in the manner of a piston. As can already be seen from the drawings, the polishing disk 9 is rigidly connected to the guide element 8 in a non-tiltable manner.

Figure 5:
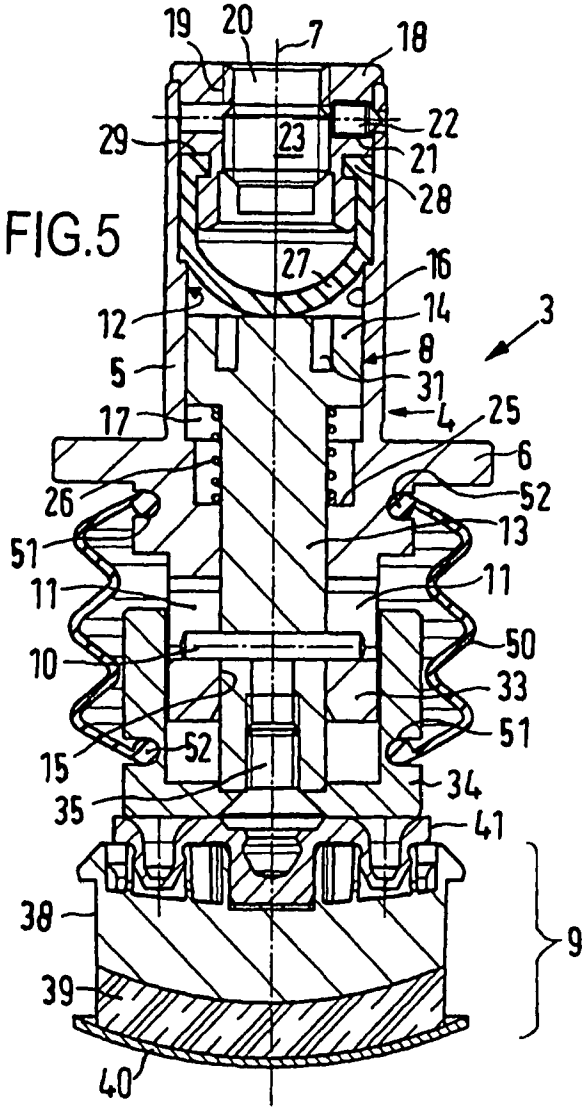
FIG. 5 shows a longitudinal section, similar to FIG. 2, through the polishing tool but in a position in which pressure is applied.

A stop pin 10 is non-displaceably inserted in the guide element 8 transversely to the tool rotation axis 7 and, in order to connect the main body 4, which is driven in rotation by the tool spindle 1, to the guide element 8 in a rotationally fixed manner by engaging an axial groove 11 which is provided in the main body 4. In the illustrated example, the axial groove 11 is located on both sides of the guide element 8, and the stop pin 10 protrudes from the guide element 8 on both sides so as to engage with the axial groove 11 which is split in two, as shown in FIGS. 2 and 5. The axial length of the axial groove 11 limits the maximum displacement travel of the guide element 8 in the main body 4.

A spring force acting on the guide element 8 displaces the guide element 8 in the basic position of the tool 3 until the stop pin 10 comes into abutment against one end of the two ends of the axial groove 11, in the example shown in FIGS. 1 and 2 against the end of the axial groove 11 adjacent to the flange 6, as will be described further below.

A stepped bore 12 is provided in the main body 4 to accommodate the guide element 8 in a manner coaxial with the tool rotation axis 7. The guide element 8 has a shaft section 13 and a head section 14. The shaft section 13 emerges from the main body 4 in the direction of the polishing disk 9 through a guide section 15 of the stepped bore 12 which has the smallest diameter of the stepped bore 12. The head section 14 of the guide element 8 is guided in a bore section 16 of the stepped bore 12 which has a larger diameter than the guide section 15 of the stepped bore 12, as a result of which a receiving space 17 which surrounds the guide section 15 is formed in the stepped bore 12.

Figure 10:
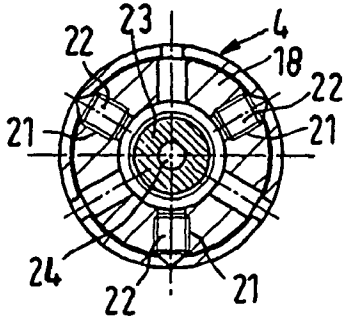
FIG. 10 shows the cross section through the fine-grinding tool along the section line X-X in FIG. 8.

The stepped bore 12 is closed at its end adjacent to the tool spindle 1 by a closure piece 18 which can be fixed to the main body 4. The closure piece 18 has a central bore 20 coaxial with the tool rotation axis 7 and provided with an internally threaded section 19. As can be seen from FIG. 2 in conjunction with FIG. 10 of the example of embodiment described further below, provided in the closure piece 18 are a plurality of threaded bores 21 which extend radially to the central bore 20 and into which pin screws 22 are screwed in order to fix the closure piece 18 in the shaft 5 of the main body 4.

A grub screw 23 which has a through-bore 24 is screwed into the internally threaded section 19 of the central bore 20 of the closure piece 18. A first helical compression spring 26 which surrounds the shaft section 13 of the guide element 8 and which is located in the receiving space 17 is inserted between the head section 14 of the guide element 8 and a step 25 of the stepped bore 12. Said first helical compression spring, in the basic position of the tool 3, keeps the stop pin 10 in the position of abutment against the end of the axial groove 11 of the main body 4 adjacent to the first helical compression spring 26, said position of abutment being shown in FIGS. 1 and 2. Attached to the closure piece 18 is an elastic membrane 27 which for this purpose engages with an inner annular protrusion 28 in a corresponding annular groove 29 on the closure piece 18.

In the basic position of the tool 3, the membrane 27 bears against the head section 14 of the guide element 8, as shown in FIGS. 1 and 2. The membrane 27 can be made to bulge outwards by supplying compressed air through the through-bore 24 of the grub screw 23 in order to displace the guide element 8 towards the polishing disk 9, as a result of which the machining pressure of the polishing disk 9 on the workpiece (not shown) is generated. In its maximum bulging position, the membrane 27 keeps the stop pin 10 in the position of abutment against the end of the axial groove 11 of the main body 4 facing towards the polishing disk 9, counter to the force of the first helical compression spring 26, as shown in FIG. 5. During machining operation, an intermediate position of the stop pin 10 between the two positions of abutment in the axial groove 11 is set.

Figure 9:
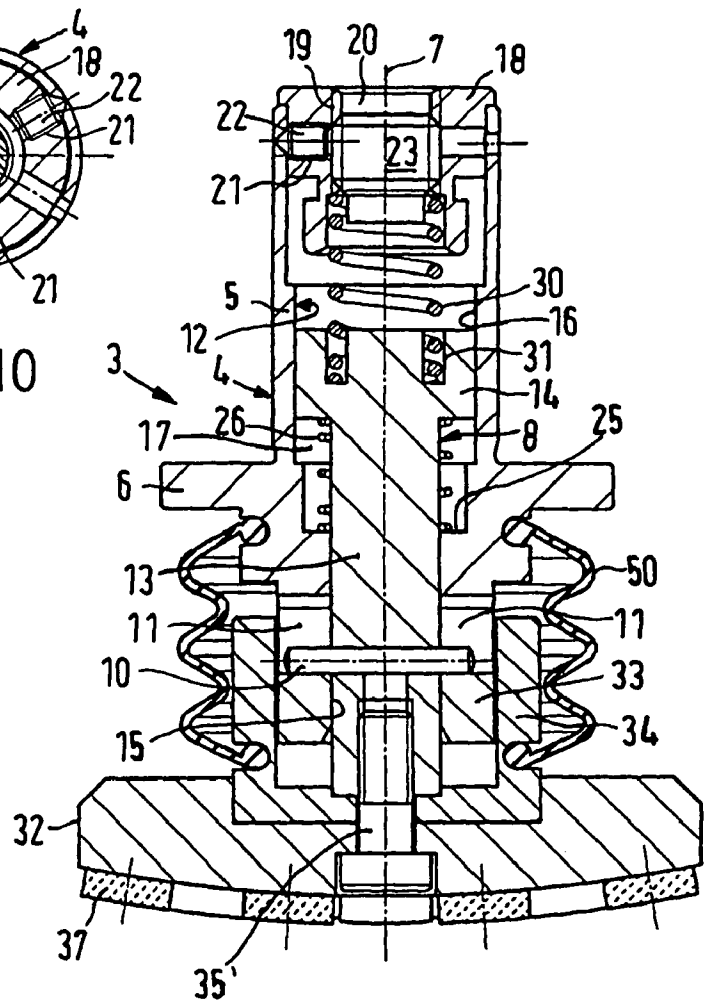
FIG. 9 shows a further longitudinal section through the fine-grinding tool along the section line IX-IX in FIG. 8.
Figure 8:
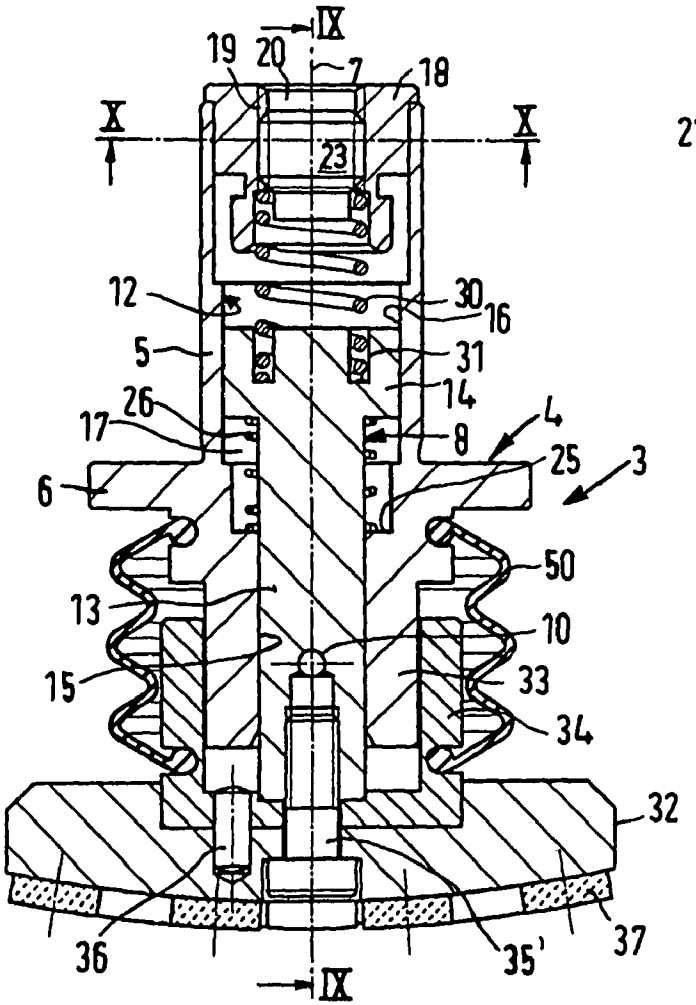
FIG. 8 shows a longitudinal section through a fine-grinding tool acting only by a spring force, in its basic position.

In the example of embodiment shown in FIGS. 8 and 9, instead of the membrane 27, a second helical compression spring 30 is provided which has a greater spring force than the first helical compression spring 26. The second helical compression spring 30, which generates the machining pressure on the workpiece, is supported at one side against the grub screw 23 and can be adjusted by the grub screw 23 in terms of its prestress, which grub screw for this purpose is screwed to a greater or lesser extent into the internally threaded section 19 of the closure piece 18. At the other side, the second helical compression spring 30 bears with prestress against the head section 14 of the guide element 8, where it engages in a groove 31 concentric with the tool rotation axis 7. The second compression spring 30 displaces the guide element 8 counter to the force of the weaker first helical compression spring 26, which would also be superfluous in this example of embodiment, into the basic position of the tool 3 in which the stop pin 10 is kept in the position of abutment against the end of the axial groove 11 facing towards the machining disk, in this example of embodiment the grinding disk 32.

As can be seen from FIGS. 1, 2, 5, 8 and 9, a beaker-shaped part 34 is pushed with movement play in a telescopic manner onto the cylindrical end 33 of the main body 4 facing towards the polishing disk 9 or the grinding disk 32. In the first example of embodiment (FIGS. 1, 2), the beaker-shaped part 34 is fixed directly to the guide element 8 by a central screw 35. In the second example of embodiment (FIGS. 8, 9), the beaker-shaped part 34, against which the machining disk designed as a grinding disk 32 bears, is jointly fixed with the grinding disk 32 to the guide element 8 by a central screw 35'. In addition, in this case, at least one cylindrical pin 36 (FIG. 8) is provided which connects the grinding disk 32 to the beaker-shaped part 34 and which is arranged at a radial distance from the tool rotation axis, said cylindrical pin ensuring the rotational entrainment of the grinding disk 32. The grinding disk 32 is provided on its machining side with grinding pellets 37, the grinding particles of which are preferably bound to a plastic mass and can be trimmed with regard to their shape.

The polishing disk 9 used in the example of embodiment shown in FIGS. 1 to 9 may have the structure shown in EP 1 698 432 A2 or DE 10 2007 026 841 A1, which are hereby incorporated by reference, including a support body 38, a foam layer 39 fixed thereon, and a polishing film 40 connected thereto.

Figure 6:
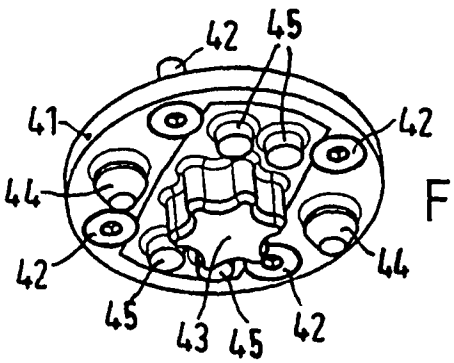
FIG. 6 shows the holding section of FIG. 3 in a perspective view.

In order to allow rapid replacement of the polishing disk 9, a holding section 41 is provided between the beaker-shaped part 34 and the polishing disk 9 and is fixed to the beaker-shaped part 34 by a plurality of screws 42, as can be seen from FIGS. 3 and 6. The holding section 41 serves for the latching connection of the polishing disk 9 in a rotationally fixed manner, as will be described below.

The holding section 41 and the support body 38 are injection-molded from a suitable plastic, in each case in one piece with all the protrusions and depressions provided thereon. To explain the holding section 41, reference is made to FIGS. 3 and 6.

On its side facing towards the beaker-shaped part 34, the holding section 41 is of flat design so as to bear fully against the flat end face of the beaker-shaped part 34. Integrally formed on its side facing towards the support body 38 is a central protrusion 43 which is designed in the manner of a Torx profile at its circumference. Also integrally formed are two diametrically opposed latching protrusions 44 and four pin-type protrusions 45 which are arranged in pairs and diametrically opposite one another. Finally, four through-bores are also provided for receiving the screws 42.

Figure 7:
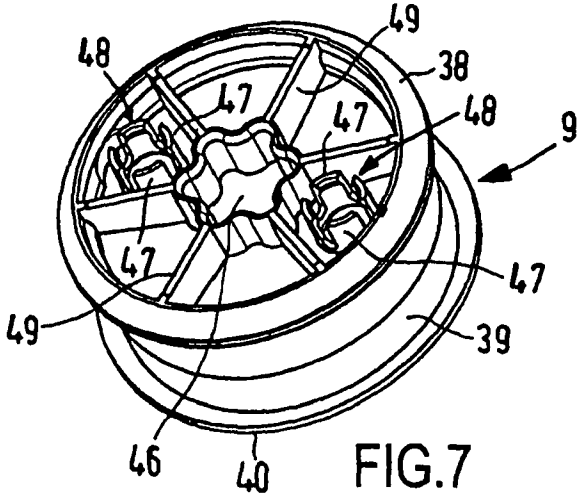
FIG. 7 shows the polishing disk of FIG. 4 in a perspective view.

The support body 38 which can be seen in FIGS. 4 and 7 is designed in a complementary manner on its side facing towards the holding section 41. It has a central profiled depression 46 so as to receive in a rotationally fixed manner the corresponding central protrusion 43 of the holding part 41, two diametrically opposed latching sleeves 48 which are formed by in each case four flexible arms and which together with the latching protrusions 44 of the holding part 41 form snap-in connections for releasably fixing the polishing disk 9, and six integrally formed webs. Of the webs, the two webs 49 located opposite one another are received during the latching process between the pin-type protrusions 45 arranged in pairs, and thus ensure that the polishing disk 9 is placed onto the holding section 41 in the correct, i.e. non-twisted, position, in which the latching protrusions 44 enter into engagement with the latching sleeves 48.

The two examples of embodiments share the common feature that the main body 4 and the beaker-shaped part 34 are connected to one another by a surrounding elastic bellows 50. For this purpose, circumferential grooves 51 are formed on the beaker-shaped part 34 and on the main body 4, in which end rings 52 of the bellows 50 engage.

Variations and modifications are possible without departing from the scope and spirit of the present invention as defined by the appended claims.

I claim:

1. A tool for polishing and fine-grinding optically active surfaces in precision optics comprising:

a main body which can be attached in a rotationally fixed manner to a tool spindle of a machining machine;

a guide element which is arranged concentrically in the main body and is mounted such that it can be displaced axially therein, said guide element having a full displacement travel;

a machining disk which is replaceably attached to the outer end of the guide element and on the outer surface of which at least one of polishing and grinding means is provided;

wherein the main body is rigidly connected in a rotationally fixed manner, over the full displacement travel, to the guide element mounted such that it can be displaced axially therein;

wherein the machining disk is rigidly fixed in a non-tiltable manner on the guide element; and wherein the tool has a tool rotation axis and a stop pin is inserted in the guide element transversely to the tool rotation axis and, in order to connect the main body to the guide element in a rotationally fixed manner, engages in an axial groove which is provided in the main body and has two ends, and the axial groove having an axial length which limits the maximum displacement travel of the guide element in the main body, and wherein, by means of a spring force acting axially on the guide element, the guide element is displaced in a basic position of the tool until the stop pin comes into abutment against one of the ends of the axial groove.

2. A tool for polishing and fine-grinding optically active surfaces in precision optics comprising:

a main body which can be attached in a rotationally fixed manner to a tool spindle of a machining machine;

a guide element which is arranged concentrically in the main body and is mounted such that it can be displaced axially therein, said guide element having a full displacement travel;

a machining disk which is replaceably attached to the outer end of the guide element and on the outer surface of which at least one of polishing and grinding means is provided;

wherein the main body is rigidly connected in a rotationally fixed manner, over the full displacement travel, to the guide element mounted such that it can be displaced axially therein;

wherein the machining disk is rigidly fixed in a non-tiltable manner on the guide element; and wherein the tool has a tool rotation axis and a stepped bore is provided in the main body to accommodate the guide element in a manner coaxial with the tool rotation axis, and wherein the guide element has a shaft section and a head section, of which the shaft section emerges from the main body in the direction of the machining disk through a guide section having the smallest diameter of the stepped bore, while the head section of the guide element is guided in a bore section of larger diameter, wherein the stepped bore is closed at its end adjacent to the tool spindle by a closure piece which can be fixed to the main body.

3. A tool according to claim 2, wherein the closure piece has a central bore coaxial with the tool rotation axis and provided with an internally threaded section, and wherein provided in the closure piece are a plurality of threaded bores which extend radially to the central bore and into which pin screws are screwed in order to fix the closure piece in the stepped bore.

4. A tool according to claim 3, wherein a stop pin is inserted in the guide element transversely to the tool rotation axis and, in order to connect the main body to the guide element in a rotationally fixed manner, engages in an axial groove which is provided in the main body and has to ends, and the axial groove having an axial length which limits the maximum displacement travel of the guide element in the main body, and wherein, by means of a spring force acting axially on the guide element, the guide element is displaced in a basic position of the tool until the stop pin comes into abutment against one of the ends of the axial groove, and wherein a grub screw, which has a through-bore, is screwed into the internally threaded section of the central bore of the closure piece, and wherein a first helical compression spring which surrounds the shaft section of the guide element is inserted between the head section of the guide element and a step of the stepped bore, which first helical compression spring, in the basic position of the tool, keeps the stop pin in the position of abutment against the end of the axial groove of the main body adjacent to the first helical compression spring, wherein attached to the closure piece is an elastic membrane which bears against the head section of the guide element and can be made to bulge outwards by supplying compressed air through the through-bore in order to displace the guide element so as to generate the machining pressure on the workpiece and, in its maximum bulging position, keeps the stop pin in the position of abutment against the end of the axial groove of the main body facing towards the machining disk, counter to the force of the first helical compression spring.

5. A tool according to claim 3, wherein a stop pin is inserted in the guide element transversely to the tool rotation axis and, in order to connect the main body to the guide element in a rotationally fixed manner, engages in an axial groove which is provided in the main body and has two ends, and the axial groove having an axial length which limits the maximum displacement travel of the guide element in the main body, and wherein, by means of a spring force acting axially on the guide element, the guide element is displaced in a basic position of the tool until the stop pin comes into abutment against one of the ends of the axial groove, and wherein a grub screw is screwed into the internally threaded section of the central bore of the closure piece, against which grub screw there is supported one end of a second helical compression spring which can be adjusted by the grub screw in terms of its prestress and which generates the machining pressure on the workpiece, and wherein the other end of said second helical compression spring bears against the head section of the guide element and, in the basic position of the tool, keeps the stop pin in the position of abutment against the end of the axial groove of the main body facing towards the machining disk.

6. A tool for polishing and fine-grinding optically active surfaces in precision optics comprising:

a main body which can be attached in a rotationally fixed manner to a tool spindle of a machining machine;

a guide element which is arranged concentrically in the main body and is mounted such that it can be displaced axially therein, said guide element having a full displacement travel;

a machining disk which is replaceably attached to the outer end of the guide element and on the outer surface of which at least one of polishing and grinding means is provided;

wherein the main body is rigidly connected in a rotationally fixed manner, over the full displacement travel, to the guide element mounted such that it can be displaced axially therein;

wherein the machining disk is rigidly fixed in a non-tiltable manner on the guide element; and wherein the main body has a cylindrical end facing towards the machining disk, and wherein a beaker-shaped part is pushed with movement play in a telescopic manner onto the cylindrical end and is fixed to the guide element by a central screw.

7. A tool according to claim 6, wherein a holding section is fixed to the beaker-shaped part by a plurality of screws and serves for the latching connection of the machining disk which is designed as a polishing disk, in a rotationally fixed manner.

8. A tool according to claim 6, wherein the beaker-shaped part and the machining disk, which is designed as a grinding disk, which bears against the beaker-shaped part, are jointly fixed to the guide element by the central screw, wherein the rotational entrainment of the grinding disk is ensured by at least one cylindrical pin which connects the grinding disk to the beaker-shaped part and which is arranged at a radial distance from the tool rotation axis.

9. A tool according to claim 6, wherein the main body and the beaker-shaped part are connected to one another by a surrounding bellows.

* * * * *